US006160530A

United States Patent [19]

Makino

[11] Patent Number: 6,160,530

[45] Date of Patent: Dec. 12, 2000

[54] METHOD AND DEVICE FOR DRIVING A PLASMA DISPLAY PANEL

[75] Inventor: Mitsuyoshi Makino, Tokyo, Japan

[73] Assignee: NEC Corporation, Tokyo, Japan

[21] Appl. No.: 09/053,824

[22] Filed: Apr. 2, 1998

[30] Foreign Application Priority Data

Apr. 2, 1997 [JP] Japan ..... 9-083902
May 2, 1997 [JP] Japan ..... 9-114787

[51] Int. Cl.[7] ..... G09G 3/28

[52] U.S. Cl. ..... 345/60; 345/63; 345/67; 345/68; 315/169.4

[58] Field of Search ..... 345/60, 63, 67, 345/68; 315/169.4

[56] References Cited

U.S. PATENT DOCUMENTS

| | | | |
|---|---|---|---|
| 5,745,086 | 4/1998 | Weber | 345/60 |
| 5,828,356 | 10/1998 | Stoller | 345/60 |
| 5,854,540 | 12/1998 | Matsumoto et al. | 315/169.4 |
| 5,903,245 | 5/1999 | Shimizu et al. | 345/60 |
| 5,943,031 | 8/1999 | Tokunaga et al. | 345/60 |

FOREIGN PATENT DOCUMENTS

| | | |
|---|---|---|
| 51-3719 | 1/1976 | Japan . |
| 51-61247 | 5/1976 | Japan . |
| 56-104389 | 8/1981 | Japan . |
| 58-2887 | 1/1983 | Japan . |
| 59-181393 | 10/1984 | Japan . |
| 60-225896 | 11/1985 | Japan . |
| 2-87189 | 3/1990 | Japan . |
| 4-4542 | 3/1990 | Japan . |
| 3-179489 | 8/1991 | Japan . |
| 5-6147 | 1/1993 | Japan . |
| 8-160910 | 6/1996 | Japan . |
| 9-259767 | 10/1997 | Japan . |
| 10-31453 | 2/1998 | Japan . |

*Primary Examiner*—Bipin Shalwala
*Assistant Examiner*—Vincent E. Kovalick
*Attorney, Agent, or Firm*—McGinn & Gibb, P.C.

[57] ABSTRACT

In an AC drive type plasma display panel, a pre-discharge pulse and/or a sustain discharge pulse has a leading-edge voltage changing rate of less than 100 V/$\mu$s.

18 Claims, 8 Drawing Sheets

METHOD AND DEVICE FOR DRIVING A PLASMA DISPLAY PANEL

BACKGROUND OF THE INVENTION

1. Field of the Invention

The present invention relates to a method and a device for driving a plasma display panel (abbreviated as "PDP"), used as a flat display easy to realize a large display area, for example as a display for a personal computer and a work station, and a wall television receiver, and more specifically to a method and a device for driving an AC drive type plasma display panel (abbreviated as "AC-PDP").

2. Description of Related Art

In general, the PDP is divided into a DC type and an AC type, on the basis of a difference in a driving method. In the DC type, electrodes are exposed to a discharge gas, and a discharge occurs only a period in which a voltage is applied. In the AC type, electrodes are covered with a dielectric film and a discharge occurs without exposing the electrodes to a discharge gas. In the AC-PDP, furthermore, a discharge cell itself has a memory function because of an electric charge accumulating action of the dielectric film.

Referring to FIG. 1, there is shown a diagrammatic section view of a conventional AC-PDP. The shown AC-PDP includes a front substrate 10 and a back substrate 11 which are formed of a glass and which are fixed separately from each other by a predetermined distance to define a space therebetween.

On an inside surface of the front substrate 10, scan electrodes 12 and common electrodes 13 are formed with a predetermined interval, and covered with an insulating layer 15*a*, which is coated with a protection layer 16 formed of for example MgO, etc., in order to protect the insulating layer 15*a* from an electric discharge.

On an inside surface of the back substrate 11, data electrodes 19 are formed to extend in a direction orthogonal to the scan electrodes 12 and the common electrodes 13. The data electrodes 19 are covered with an insulating layer 15*b*, which is coated with a phosphor 18 in order to convert ultraviolet generated by the electric discharge, into a visible light.

Between the insulating layer 15*a* of the front substrate 10 and the insulating layer 15*b* of the back substrate 11, a partition wall 17 is formed to ensure a discharge space 20 between the front substrate 10 and the back substrate 11 and also to define each pixel. A discharge gas composed of a mixed gas of He, Ne, Xe, and others is sealed in the discharge space.

Referring to FIG. 2, there is shown a diagrammatic plan view of the scan electrodes 12, the common electrodes 13 and the data electrodes 19 shown in FIG. 1.

In FIG. 2, "m" scan electrodes Si (i=1, 2, . . . , m) are formed in a row direction, and "n" data electrodes Dj (j=1, 2 . . . , n) are formed in a column direction, so that one pixel is formed at each of intersections between the scan electrodes Si and the data electrodes Dj. Common electrodes Ci are formed in the row direction so that each of the common electrodes Ci is paired with a corresponding one of the scan electrodes Si. In the shown example, the common electrodes Ci and the scan electrodes Si are located in parallel. If the phosphor 18 shown in FIG. 1 is divided into three colors of red, green and blue in units of pixel, a color display PDP can be obtained.

Now, a method for driving the conventional PDP will be described with reference to FIG. 3, which is a timing chart illustrating various driving voltages applied to respective electrodes of the AC-PDP shown in FIGS. 1 and 2.

First, an erase pulse 21 is applied to all the scan electrodes S1 to Sm, to erase light emitting pixels which had emitted light until the erase pulse 21 is applied. As a result, all the pixels are put into an erased condition.

Next, a pre-discharge pulse 22 is applied to all the common electrodes C1 to Cm, to forcibly cause an electric discharge in all the pixels, and then, a pre-discharge erase pulse 23 is applied to all the scan electrodes S1 to Sm, to erase the pre-discharge of all the pixels. This pre-discharge facilitates a writing discharge which will be carried out later. Therefore, since this pre-discharge for facilitating the writing discharge has to be certainly caused in all the pixels, the pre-discharge pulse 22 is generally set to have a sufficiently high voltage and a sufficiently long pulse width.

After the erase of the pre-discharge, a scan pulse 24 is applied to the scan electrodes S1 to Sm at timings shifted from one another, respectively, and on the other hand, data pulses 27 are applied to the data electrodes D1 to Dn, respectively, in time with application of the scan pulse 24. In FIG. 3, a slash given in the data pulses 27 indicates that presence/non-presence of the data pulse has been determined in accordance with presence/non-presence of a display data. In the pixel in which the data pulse 27 is applied when the scan pulse 24 is applied, a writing discharge is generated in the discharge space 20 between the scan electrode 12 and the data electrode 19, but in the pixel in which the data pulse 27 is not applied, no writing discharge is generated.

In the pixel in which the writing discharge has been generated, namely, in the pixel which the display data is "ON", a positive electric charge, called a "wall charge", is accumulated in the insulating layer 15*a* on the scan electrode 12. At this time, a negative wall charge is accumulated in the insulating layer 15*b* on the scan electrode 12.

Thereafter, with superposition of the positive potential created by the positive wall charge established in the insulating layer 15*a* of the scan electrode 12 and a first sustain pulse 25 which is negative and which is applied to the common electrodes 13, a first sustain discharge occurs. If the first sustain discharge occurs, a positive wall charge is accumulated in the insulating layer 15*a* on the common electrode 13, and at this time, a negative wall charge is accumulated in the insulating layer 15*a* on the scan electrode 12. Succeedingly, a second sustain pulse 26 applied to the scan electrode 12 is superposed on a potential difference given by these wall charges, a second sustain discharge occurs. Thus, the sustain discharge continues by superposition of the potential difference given by the wall charges formed by an (x)th sustain discharge with an (x+1)th sustain pulse. The quantity of emitted light is controlled by the number of sustain discharges.

By previously determining the voltage of the sustain pulses 25 and 26 at such a degree that the discharge never occurs with the sustain pulse alone, in the pixel in which the writing discharge had not occurred, since the potential given by the wall electric charge does not exist before application of the first sustain pulse 25, the first sustain discharge does not occur although the first sustain pulse 25 is applied, and thereafter, no sustain discharge occurs.

The display contrast ratio is a value by diving the luminance when the display data is "ON", by the luminance when the display data is "OFF". In the color PDP, because of the above mentioned driving operation, in the pixel corresponding to the display data of "OFF", there occurs no light emission which is caused by the writing discharge and the sustain discharge following the writing discharge, but there exists a light emission caused by the pre-discharge. On the other hand, in the pixel corresponding to the display data of "ON", there occurs not only the light emission caused by the writing discharge and the sustain discharge following the writing discharge, but also a light emission caused by the pre-discharge. Accordingly, the display contrast ratio in the color PDP is a value obtained by dividing a total of the luminance of the light emission caused by the pre-discharge, the luminance of the light emission caused by the writing discharge and the luminance of the light emission caused by the sustain discharge following the writing discharge, by the luminance of the light emission caused by the pre-discharge. Therefore, the display contrast ratio in the color PDP can be elevated by making large the luminance of the light emission caused by the writing discharge and the luminance of the light emission caused by the sustain discharge, and/or by making the luminance of the light emission caused by the pre-discharge small.

The erase pulse 21, the pre-discharge pulse 22, the pre-discharge erase pulse 23, the scan pulse, the sustain pulses 25 and 26, and the data pulses as mentioned above are conventionally constituted of a rectangular pulse having a rising time of not greater than 1 microsecond and a falling time of not greater than 1 microsecond.

FIG. 4A illustrates a driving rectangular pulse applied to the PDP shown in FIG. 1, and FIG. 4B illustrates a discharge current flowing when the driving rectangular pulse shown in FIG. 4A is applied.

This discharge current starts to flow with a delay of several hundred nanoseconds from application of the voltage pulse, and reaches a peak with a delay of several hundred nanoseconds from the moment the discharge current starts to flow, and the discharge current terminates after it continues several hundred nanoseconds from the peak. The time from the application of the pulse to the moment the discharge current starts to flow, the time from the moment the discharge current starts to flow to the moment the moment the discharge current reaches its peak, and the continuing time of the discharge current after the peak, are determined by the structure of the PDP, including the composition of the discharge gas, the composition and the thickness of the dielectric layer, the composition and the size of the electrodes, and the size of the discharge space. When the discharge is caused by the rectangular pulse shown in FIG. 4A, the higher the peak value "V" of the pulse is, and the larger the pulse width "t" is, the large the luminance of the emitted light becomes.

In the above mentioned AC-PDP, in order to stably generate the writing discharge, it is necessary to surely cause the pre-discharge. In the above mentioned conventional AC-PDP driving method, in order to elevate the sureness of the generation of the pre-discharge, the pre-discharge pulse was set to have a high voltage and a long pulse width. As a result, the luminance of the emitted light caused by the pre-discharge has become large, with the result that the display contrast ratio has become low.

Furthermore, in the conventional PDP, the luminance efficiency of the discharge is low, and therefore, the power consumption is large.

SUMMARY OF THE INVENTION

Accordingly, it is an object of the present invention to provide a method and a device for driving a plasma display panel, which have overcome the above mentioned defects of the conventional one.

Another object of the present invention is to provide a method and a device for driving a plasma display panel, capable of surely generating the pre-discharge, and of lowering the luminance of the emitted light caused by the pre-discharge, thereby to elevating the display contrast ratio.

Still another object of the present invention is to provide a method and a device for driving a plasma display panel, capable of elevating the luminance efficiency in the sustain discharge, thereby to elevate the power consumption.

The above and other objects of the present invention are achieved in accordance with the present invention by a method for driving a plasma display panel having a pair of substrates separated from each other to define a space therebetween and discharge gas sealed in the space, each of the substrates having a plurality of electrodes formed on an inside surface thereof, the plasma display panel having a high luminance condition and a low luminance condition which are separated by a leading-edge voltage changing rate of a voltage for generating a discharge between the electrodes, the method including the step of supplying a pre-discharge pulse to a predetermined electrode of the electrodes to generate a pre-discharge before a discharge is caused for a display, the improvement being that, in the pre-discharge, at least during the period from the moment a discharge current starts to flow to the moment the discharge current reaches its peak value, the leading-edge voltage changing rate of the pre-discharge pulse is at a leading-edge voltage changing rate generating the low luminance condition.

For executing the above mentioned method, according to the present invention, there is provided a device for driving a plasma display panel having a pair of substrates separated from each other to define a space therebetween and discharge gas sealed in the space, each of the substrates having a plurality of electrodes formed on an inside surface thereof, the plasma display panel having a high luminance condition and a low luminance condition which are separated by a leading-edge voltage changing rate of a voltage for generating a discharge between the electrodes, the device including an output driver for outputting a pre-discharge pulse to a predetermined electrode of the electrodes to generate a pre-discharge before a discharge is caused for a display, and a means connected to an output of the output driver for slowing down the leading-edge voltage changing rate of the pre-discharge pulse outputted by the output driver.

In the plasma display panel having a pair of substrates separated from each other to define a space therebetween and discharge gas sealed in the space, each of the substrates having a plurality of electrodes formed on an inside surface thereof, so that light is emitted by a discharge generated between the electrodes, it has been known from experiment that the luminance of the emitted light caused by the discharge abruptly drops when the leading-edge voltage changing rate of the voltage for generating the discharge between the electrodes becomes lower than a certain value. Namely, the plasma display panel changes from a high luminance condition to a low luminance condition when the leading-edge voltage changing rate of the discharge voltage becomes lower than the certain value. Therefore, by making the leading-edge voltage changing rate (a voltage falling rate or a voltage rising rate) of the pre-discharge pulse less than the certain value (which is a boundary from which the luminance of the emitted light caused by the discharge starts to abruptly drop when the leading-edge voltage changing rate of the discharge voltage is caused to lower), the luminance of the emitted light caused by the pre-discharge can be minimized. In the present invention, since at least during the period from the moment the discharge current starts to flow to the moment the discharge current reaches its peak value, the leading-edge voltage changing rate of the pre-discharge pulse is at a leading-edge voltage changing rate generating the low luminance condition, the luminance of the emitted light caused by the pre-discharge becomes remarkably smaller than that in the prior art plasma display panel driving method using the pre-discharge pulse having the leading-edge voltage changing rate generating the high luminance condition.

According to a second aspect of the present invention, there is provided a method for driving a plasma display panel having a pair of substrates separated from each other to define a space therebetween and discharge gas sealed in the space, one of the substrates having a plurality of scan electrodes formed in parallel on an inside surface thereof, the other of the substrates having a plurality of data electrodes formed in parallel on an inside surface thereof, orthogonally to the scan electrodes so that one pixel is defined at each of intersections between the scan electrodes and the data electrodes, wherein a display data of each pixel is on-off controlled by a scan pulse applied to the scan electrodes and a data pulse applied to the data electrodes, and thereafter, a series of sustain discharge pulses are applied to at least the scan electrodes to generate a sustain discharge in only the pixels in which the display data have been put in an on condition, the improvement being that at least one of the sustain discharge pulses has a leading-edge voltage changing rate of less than 100 V/$\mu$s.

For executing the above mentioned method in accordance with the second aspect of the present invention, according to the present invention, there is provided a device for driving a plasma display panel having a pair of substrates separated from each other to define a space therebetween and discharge gas sealed in the space, one of the substrates having a plurality of scan electrodes formed in parallel on an inside surface thereof, the other of the substrates having a plurality of data electrodes formed in parallel on an inside surface thereof, orthogonally to the scan electrodes so that one pixel is defined at each of intersections between the scan electrodes and the data electrodes, wherein a display data of each pixel is on-off controlled by a scan pulse applied to the scan electrodes and a data pulse applied to the data electrodes, and thereafter, a series of sustain discharge pulses are applied to at least the scan electrodes to generate a sustain discharge in only the pixels in which the display data have been put in an on condition, the device including an output driver for outputting a sustain discharge pulse, and a means connected between an output of the output driver and the scan electrodes, for slowing down the leading-edge voltage changing rate of the sustain discharge pulse outputted by the output driver and supplied to the scan electrodes.

In the above mentioned plasma display panel driving, since the sustain discharge pulses has a leading-edge voltage changing rate of less than 100 V/$\mu$s, the luminance efficiency in the sustain discharge is remarkably elevated, as will be explained later in detail.

The above and other objects, features and advantages of the present invention will be apparent from the following description of preferred embodiments of the invention with reference to the accompanying drawings.

DESCRIPTION OF THE PREFERRED EMBODIMENTS

Figure 5:
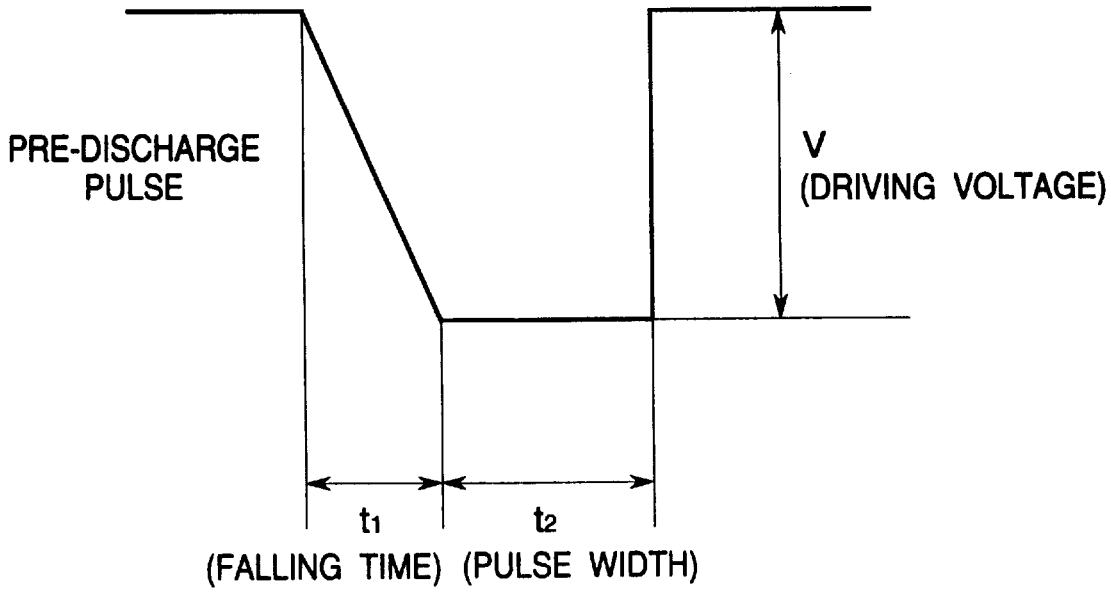
FIG. 5 illustrates the pulse shape of the negative pre-discharge pulse applied to the AC drive type plasma display panel, in a first embodiment of the plasma display panel driving method in accordance with the first aspect of the present invention.

Referring to FIG. 5, there is shown the pulse shape of the pre-discharge pulse applied to the AC drive type plasma display panel in a first embodiment of the plasma display panel driving method in accordance with the first aspect of the present invention.

Figure 1:
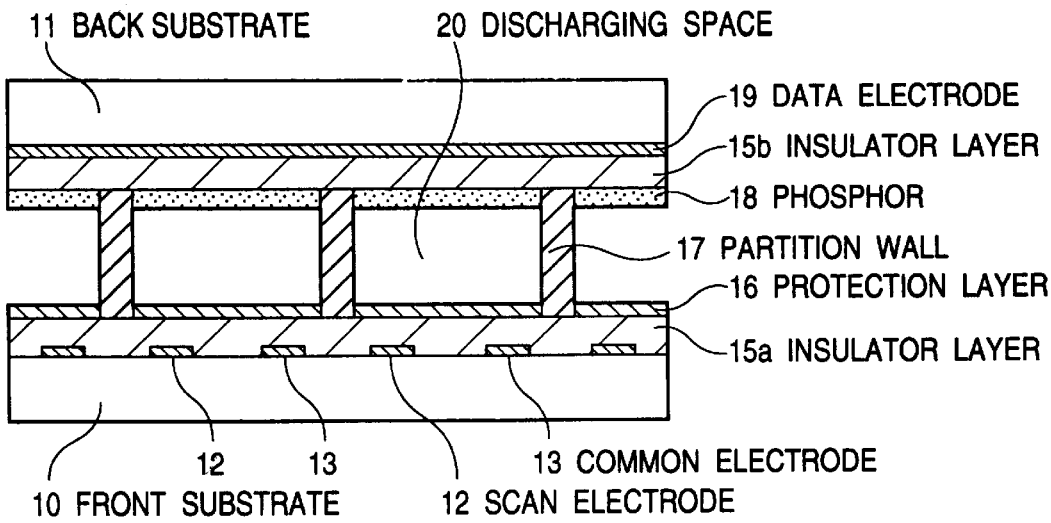
Fig. 1 PRIOR ART
FIG. 1 is a diagrammatic section view of a conventional AC drive type plasma display panel.
Figure 2:
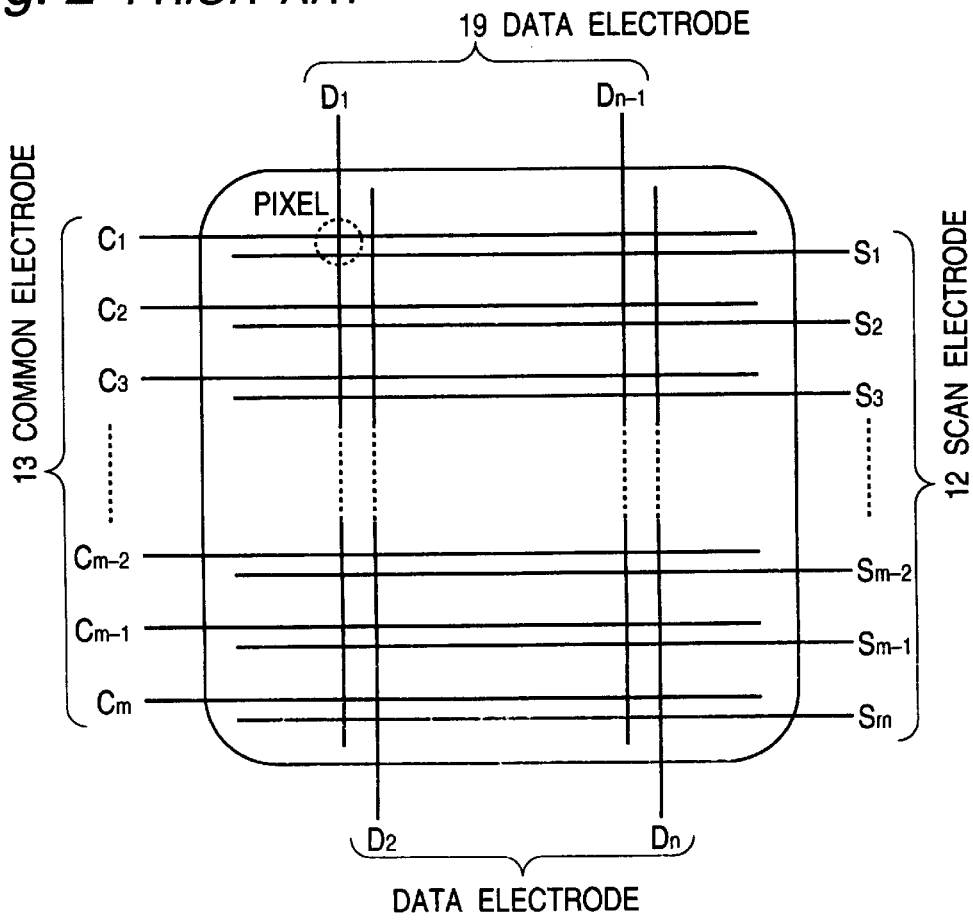
Fig. 2 PRIOR ART
FIG. 2 is a diagrammatic plan view of the scan electrodes, the common electrodes and the data electrodes shown in FIG. 1.
Figure 3:
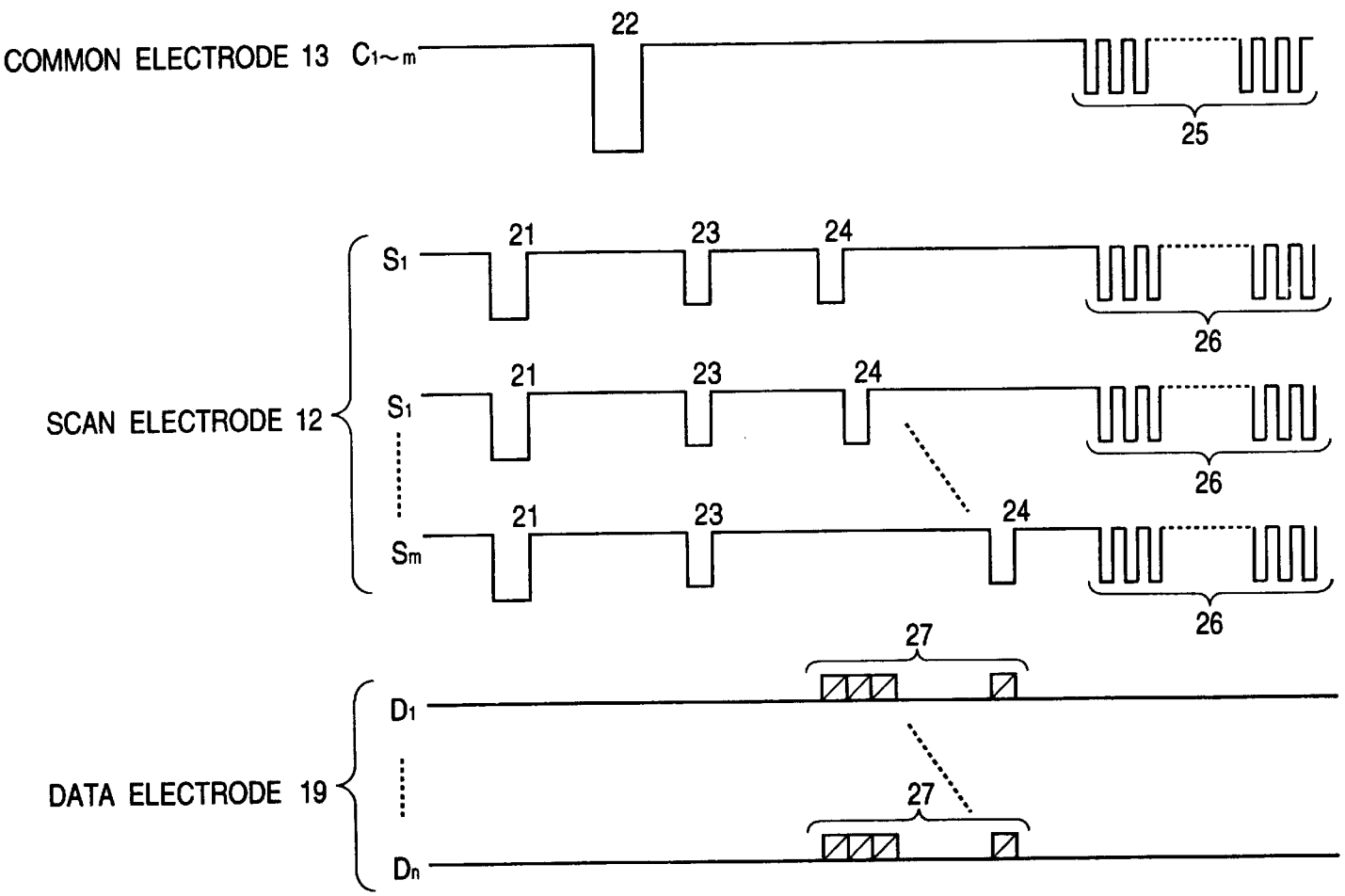
Fig. 3 PRIOR ART
FIG. 3 is a timing chart illustrating various driving voltages applied to respective electrodes of the AC drive type plasma display panel shown in FIGS. 1 and 2.

In the first embodiment of the plasma display panel driving method in accordance with the first aspect of the present invention, the pre-discharge pulse having the voltage falling rate $V/t_1$ as shown in FIG. 5 is used, and the plasma display panel similar to that shown in FIGS. 1 and 2 is driven with the timings as shown in FIG. 3. Since the structure of the plasma display panel and the driving timing for the plasma display panel are the same as those mentioned hereinbefore, explanation will be omitted for simplification of description.

In the following, the pre-discharge pulse having the voltage falling rate $V/t_1$, which is the feature of the present invention, will be described.

Figure 6:
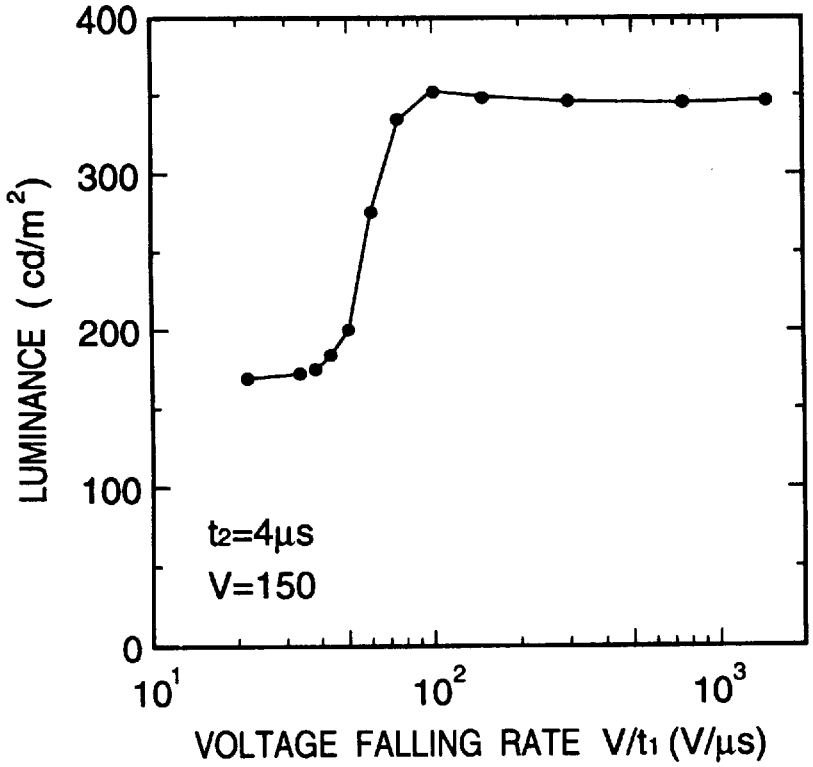
FIG. 6 is a graph illustrating the relation between the voltage falling rate and the luminance in the plasma display panel.

FIG. 6 is a graph illustrating the relation between the voltage falling rate $V/t_1$ and the luminance in the plasma display panel when the peak value "V" of the pulse is 150 V and the peak width "$t_2$" of the pulse is 4 μs. As seen from FIG. 6, if the voltage falling rate $V/t_1$ becomes lower than 100 V/μs, the luminance abruptly drops, and is saturated at less than 35 V/μs. Thus, the luminance changes from a high condition to a low condition when the voltage falling rate $V/t_1$ becomes lower than a certain rate which constitutes a boundary. In this embodiment, the voltage falling rate $V/t_1$ of the pre-discharge pulse is set to be lower than 100 V/μs, namely, to bring the luminance into the low condition, thereby to minimize the luminance of the emitted light caused by the pre-discharge.

Figures 4A, 4B:
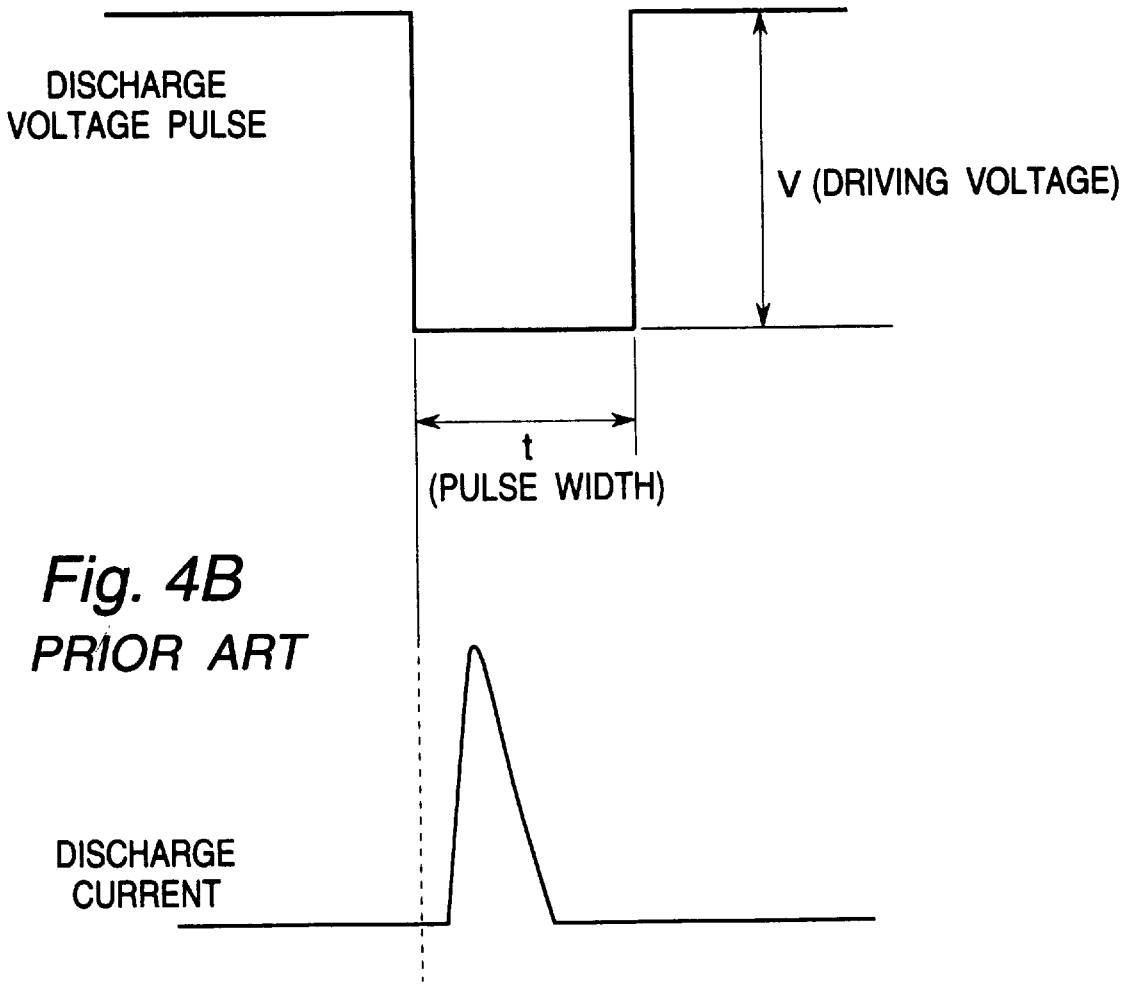
Fig. 4A PRIOR ART
Fig. 4B PRIOR ART
FIG. 4A illustrates a driving rectangular pulse applied to the AC drive type plasma display panel shown in FIG. 1.
FIG. 4B illustrates a discharge current flowing when the driving rectangular pulse shown in FIG. 4A is applied.

For example, assuming that the voltage of the pre-discharge pulse necessary to surely generate the pre-discharge in all the pixels is −300 V, the luminance caused by the pre-discharge using the pre-discharge pulse having the voltage falling rate of less than 100 V/μs, namely, the voltage falling time "$t_1$" of greater than 3 microseconds, is remarkably lower than the luminance caused by the pre-discharge using the prior art rectangular pre-discharge pulse (as shown in FIG. 4A).

As mentioned above, in the plasma display panel driving method of this first embodiment, the pre-discharge is generated by using the pre-discharge pulse having the voltage falling rate of less than 100 V/μs. With this arrangement, the luminance of the emitted light caused by the pre-discharge can be minimized, and simultaneously, the pre-discharge can be surely generated in all the pixels.

As seen from the above, the plasma display panel driving method of the first embodiment is characterized in that after the erase pulse is applied to all the scan electrodes to bring all the pixels into an erased condition, the pre-discharge is generated by using the pre-discharge pulse having the voltage falling rate of less than 100 V/μs, to forcibly discharge in all the pixels. Here, the peak voltage "V" of the pre-discharge pulse is set to have a voltage sufficient to surely generate the pre-discharge in all the pixels, but since the voltage falling rate "$V/t_1$" of the pre-discharge pulse is set to be less than 100 V/μs, the luminance of the emitted light caused by the pre-discharge becomes remarkably lower than the luminance caused by the pre-discharge using the prior art rectangular pre-discharge pulse. As a result, the plasma display panel driving method of the first embodiment can surely generate the pre-discharge in all the pixels, and at the same time, can minimize the luminance of the emitted light caused by the pre-discharge. Thereafter, the pre-discharge erase pulse is applied to erase the pre-discharge in all the pixels. After the erasing of the pre-discharge, the scan pulse is applied to the scan electrodes at timings shifted from one another, respectively, and on the other hand, data pulses are applied to the data electrodes, respectively, in time with application of the scan pulse, and in accordance with a display data, to conventionally display the data to be displayed.

Incidentally, the luminance characteristics shown in FIG. 6 is merely one example, but in the result of various measurements using different discharge gases and different PDP structures, it was confirmed that a similar phenomenon occurs with the boundary between the high luminance condition and the low luminance condition being at the voltage falling rate of about 100 V/μs.

Figure 5A:
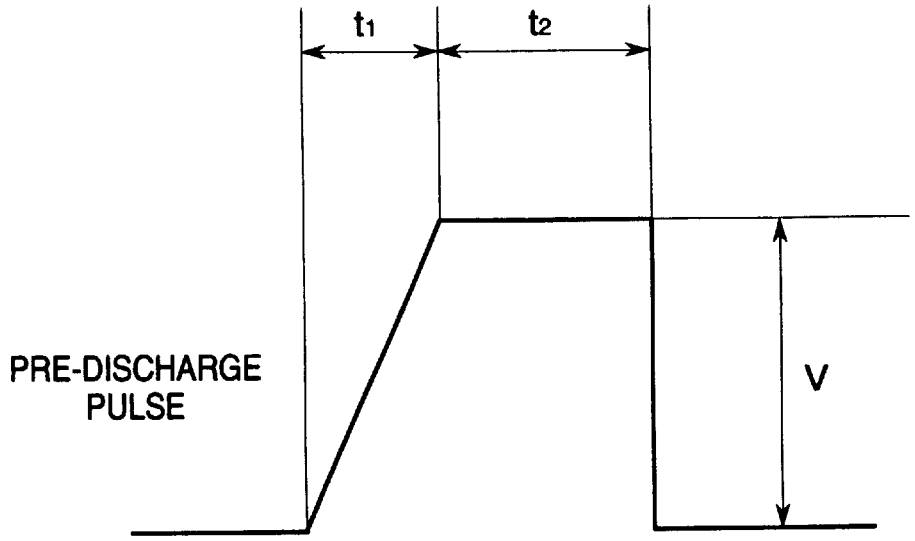
FIG. 5A illustrates the pulse shape of the positive pre-discharge pulse applied to the AC drive type plasma display panel, in the first embodiment of the plasma display panel driving method in accordance with the first aspect of the present invention.

In the above explanation, the case using the negative pre-discharge pulse has been described. In the case using a positive pre-discharge pulse as shown in FIG. 5A, however, since the relation between the voltage raising rate of the positive pre-discharge pulse and the luminance similar to the luminance characteristics shown in FIG. 6 is obtained, a similar effect can be obtained by generating the pre-discharge with the positive pre-discharge pulse having the voltage rising rate of less than 100 V/μs.

Figure 7:
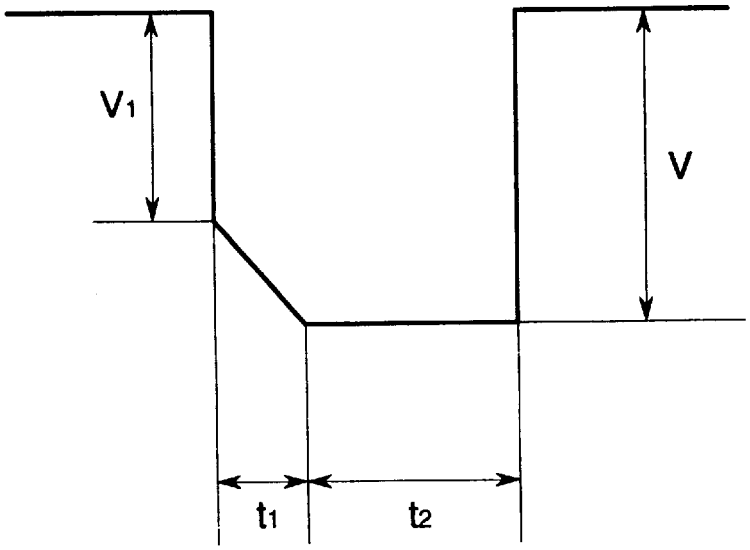
FIG. 7 illustrates the pulse shape of the pre-discharge pulse applied to the AC drive type plasma display panel, in a second embodiment of the plasma display panel driving method in accordance with the present invention.

Referring to FIG. 7, there is illustrated the pulse shape of the pre-discharge pulse applied to the AC drive type plasma display panel in the second embodiment of the plasma display panel driving method in accordance with the present invention. This second embodiment of the plasma display panel driving method is the same as the first embodiment, excepting that the pre-discharge pulse for generating the pre-discharge has the voltage falling rate of two steps, namely, two different voltage falling rates.

As shown in FIG. 7, the pre-discharge pulse in this second embodiment falls to a predetermined voltage V1 at a very large voltage falling rate similar to that of the conventional rectangular pulse, and from the predetermined voltage V1 to the peak voltage V at a voltage falling rate $(V-V1)/t_1$ which is set to be sufficiently smaller than that of the conventional rectangular pulse, and also smaller than 100 V/μs, as seen from the luminance characteristics shown in FIG. 6. With this arrangement, the luminance of the emitted light caused by the pre-discharge can be minimized.

As mentioned above, when the pre-discharge pulse having the two different voltage falling rates changing at the voltage value V1 is used, if the voltage value V1 is set to be small, the pulse shape approaches the pulse shape of the pre-discharge pulse in the first embodiment, and therefore, an effect similar to that of the first embodiment can be obtained. On the other hand, if the voltage value V1 is set to be large in a range that no pre-discharge is generated by the voltage value V1, the pre-discharge can be generated with a shorter time. For example, it is set that the voltage value V1 is −100 V and the peak voltage value V is −300 V, the time reaching the peak voltage value V becomes about 2 microsecond, which is shorter than 3 microseconds in the first embodiment.

Figure 8:
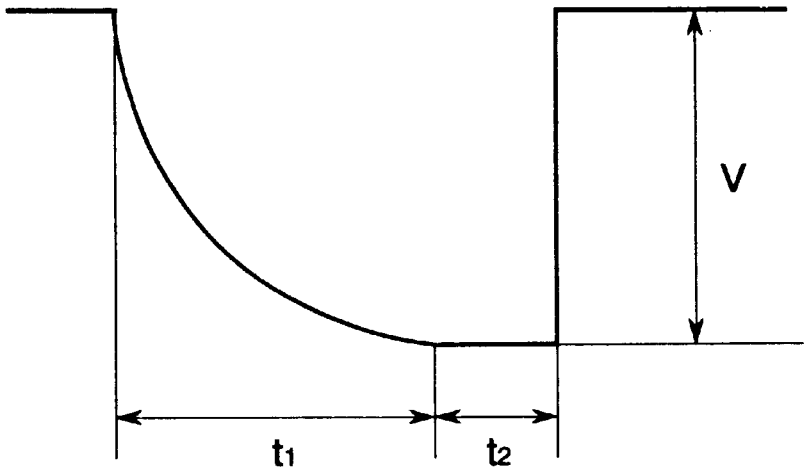
FIG. 8 illustrates the pulse shape of the pre-discharge pulse applied to the AC drive type plasma display panel, in a third embodiment of the plasma display panel driving method in accordance with the present invention.

Referring to FIG. 8, there is illustrated the pulse shape of the pre-discharge pulse applied to the AC drive type plasma display panel in the third embodiment of the plasma display panel driving method in accordance with the present invention. This third embodiment of the plasma display panel driving method is the same as the first embodiment, excepting that the pre-discharge pulse for generating the pre-discharge has the voltage falling characteristics in a sine-wave form.

As shown in FIG. 8, the pre-discharge pulse in this third embodiment is set to fall to the peak voltage value "V" to depict a sine-wave, and to have such a feature that in the time $t_1$ from the moment the voltage starts to fall to the moment the voltage reaches the peak voltage "V", a momentary voltage falling rate is smaller than 100 V/μs. In this case, the voltage falling rate can be freely set by adjusting the period and the phase of the pre-discharge pulse.

As mentioned above, even in the case that the pre-discharge pulse is set to have the momentary voltage falling rate of less than 100 V/μs, an effect similar to that of the first embodiment can be obtained.

Figure 9:
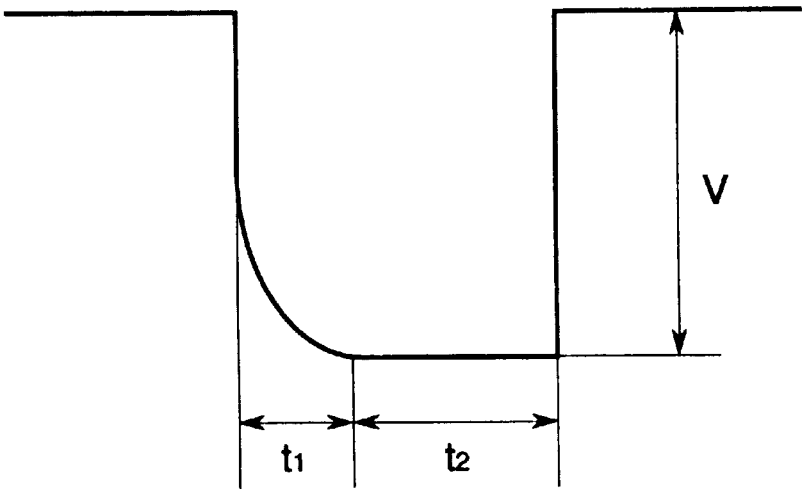
FIG. 9 illustrates the pulse shape of the pre-discharge pulse applied to the AC drive type plasma display panel, in a fourth embodiment of the plasma display panel driving method in accordance with the present invention.

Referring to FIG. 9, there is illustrated the pulse shape of the pre-discharge pulse applied to the AC drive type plasma display panel in the fourth embodiment of the plasma display panel driving method in accordance with the present invention. This fourth embodiment of the plasma display panel driving method is the same as the first embodiment, excepting that the pre-discharge pulse for generating the pre-discharge has the voltage falling characteristics in an exponential function form.

As shown in FIG. 9, the pre-discharge pulse in this third embodiment is set to fall to the peak voltage value "V" to depict an exponential function, and to have such a feature that in the time $t_1$ from the moment the voltage starts to fall to the moment the voltage reaches the peak voltage "V", a momentary voltage falling rate is smaller than 100 V/μs. In this case, the voltage falling rate can be freely set by adjusting for example an attenuation time.

As mentioned above, even in the case that the pre-discharge pulse is set to have the exponential voltage falling characteristics and the momentary voltage falling rate of less than 100 V/μs, an effect similar to that of the first embodiment can be obtained.

The above mentioned first to fourth embodiments are configured to minimize the luminance of the emitted light caused by the pre-discharge, by making the voltage falling rate of the pre-discharge pulse less than 100 V/μs which is a boundary from which the luminance of the emitted light caused by the discharge starts to abruptly drop when the voltage falling rate is caused to lower. In order to obtain this advantage, it is sufficient if the voltage falling rate is smaller than 100 V/μs, during the period from the moment the discharge current shown in FIG. 4B starts to flow to the moment the discharge current reaches its peak value.

Figure 10:
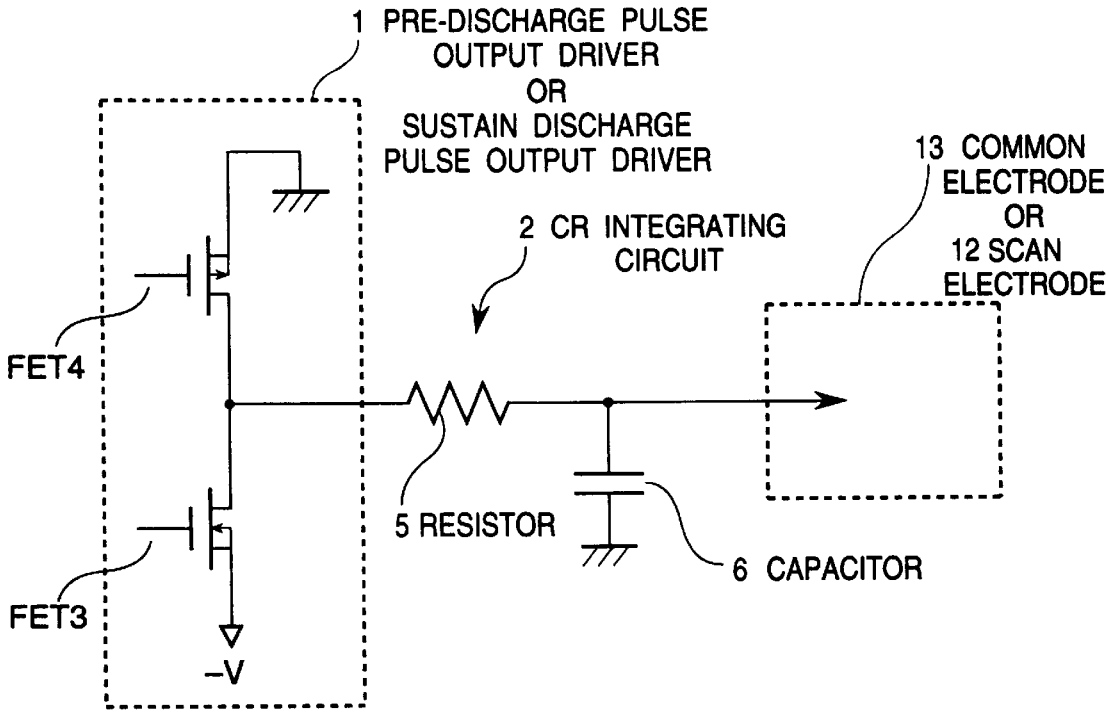
FIG. 10 is a circuit diagram of one example of the circuit for applying to the common electrode the pre-discharge pulse having the voltage falling rate of less than 100 V/$\mu$s.

Referring to FIG. 10, there is shown a circuit diagram of one example of the circuit for applying to the common electrode the pre-discharge pulse having the voltage falling rate of less than 100 V/μs (which is a boundary from which the luminance of the emitted light caused by the discharge starts to abruptly drop when the voltage falling rate is caused to lower).

The shown circuit includes a pre-discharge pulse output driver 1 comprising an N-channel field effect transistor FET3 having a source connected to a negative voltage −V as an external driving voltage and a P-channel field effect transistor FET4 having a drain connected to a drain of the FET3 and a source connected to the ground, and a CR integrating circuit 2 connected between an output of the output driver 10 and the common electrode 13. The CR integrating circuit includes a resistor 5 inserted in series in an output line extending from the output of the output driver 1 to the common electrode 13 (namely, connected between a connection node between FET3 and FET4 (constituting the output of the output driver 1) and the common electrode 13) and a capacitor 6 having one end connected to a common electrode side of the resistor 5 and the other and connected to the ground.

In the circuit having the above mentioned construction, by controlling the FET3 and the FET4, the pre-discharge pulse output driver 10 outputs a rectangular pulse. However, this rectangular pulse outputted from the pre-discharge pulse output driver 10 is deformed to a pulse having a leading edge falling in an exponential function form, by the CR integrating circuit 2 connected between the output driver 10 and the common electrode 13. This exponential function form is determined by the product of the resistance "R" of the resistor 5 and the capacitance "C" of the capacitor 6. For example, when the pre-discharge pulse output driver 10 outputs a rectangular pulse of −300 V, if C=1 nF and R=1 KΩ, the attenuation time becomes 1 microsecond, and the momentary voltage falling rate when −200 V is applied to the common electrode becomes 100 V/μs. Therefore, if the moment the discharge current starts to flow is later than the moment −200 V is applied to the common electrode, the momentary voltage falling rate is smaller than 100 V/μs, with the result that the effect mentioned hereinbefore in connection with the fourth embodiment can be obtained. Therefore, if the shown circuit is used, it is possible to easily execute the method of the fourth embodiment.

Here, the resistor 5 can be omitted from the circuit shown in FIG. 10. In this case, the CR integrating circuit is constituted of a wiring resistance (in the output line extending from the output of the output driver 1 to the common electrode 13) and the capacitor 6.

Alternatively, the capacitor 6 can be omitted from the circuit shown in FIG. 10. In this case, the CR integrating circuit is constituted of the resistor 5 and a floating capacitance (in the output line extending from the output of the output driver 1 to the common electrode 13) and a load capacitance of the common electrode 13.

In the above explanation, the case of applying the pre-discharge pulse to the common electrode has been described. The present invention can be applied to the case of applying the pre-discharge pulse to the scan electrodes to generate the pre-discharge, and to the case of simultaneously applying pulses of opposite polarities to the common electrode and the scan electrodes, respectively, so as to generate the pre-discharge by action of the superposed pulses of opposite polarities, and a similar advantage can be obtained.

The pre-discharge pulse used in the present invention is in no way limited to the pulse shapes shown in FIGS. 5 and 7 to 9, and can take any pulse shape if the voltage falling rate is smaller than 100 V/μs.

Furthermore, in the case that the pre-discharge is generated by using a plurality of pulses, the advantage of the present invention can be obtained if at least one of the plurality of pulses is set to have the voltage falling rate is smaller than 100 V/μs.

The light emission caused by the pre-discharge includes the light emission caused by the pre-discharge generated by the pre-discharge pulse and the light emission caused by the pre-discharge generated by the pre-discharge erase pulse. Therefore, if the present invention is applied to not only the pre-discharge pulse but also the pre-discharge erase pulse, the quality of display (display contrast ratio) can be further elevated.

For example, in the drive pulses shown in FIG. 3, the pre-discharge erase pulse 23 is set to have the voltage falling rate of less than 100 V/μs, the light emission caused by the pre-discharge generated by the pre-discharge erase pulse lowers in luminance, and therefore, the display contrast ratio is correspondingly elevated. Accordingly, if both of the pre-discharge pulse and the pre-discharge erase pulse are set to have the voltage falling rate of less than 100 V/μs, the display contrast ratio can be further elevated.

In this connection, in the case that a plurality of pulses are applied to surely generate the pre-discharge, and/or in the case that a plurality of pulses are applied to surely erase the pre-discharge, if the most important pulse of each plurality of pulses is set to have the voltage falling rate of less than 100 V/μs, the advantage of the present invention can be obtained most effectively. However, even if an auxiliary pulse is set to have the voltage falling rate of less than 100 V/μs, the display contrast ratio can be improved.

In the above explanation of the various modifications, the pre-discharge pulse and the pre-discharge erase pulse are a negative going pulse. If the pre-discharge pulse and the pre-discharge erase pulse are a positive going pulse, a similar advantage can be obtained by setting the pre-discharge pulse and/or the pre-discharge erase pulse to have the voltage rising rate of less than 100 V/μs.

Furthermore, the present invention can be applied to not only the AC drive type plasma display panel as mentioned above, but also the other type plasma display panels.

Figure 11:
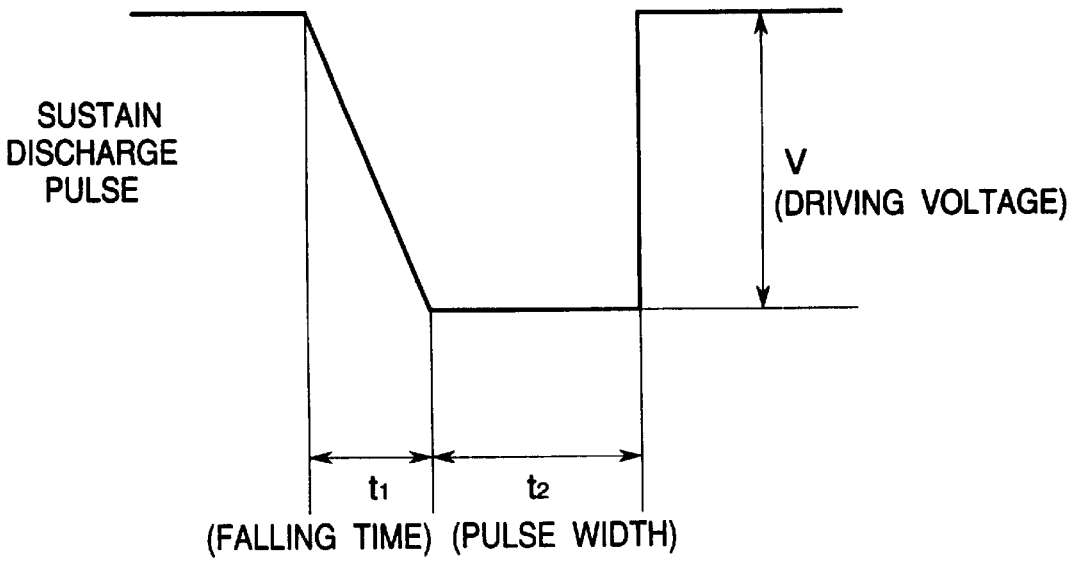
FIG. 11 illustrates the pulse shape of the negative sustain discharge pulse applied to the AC drive type plasma display panel, in the plasma display panel driving method in accordance with the second aspect of the present invention.

Referring to FIG. 11, there is illustrated the pulse shape of the positive sustain discharge pulse applied to the AC drive type plasma display panel, in the plasma display panel driving method in accordance with the second aspect of the present invention.

In the plasma display panel driving method in accordance with the first aspect of the present invention, the sustain discharge pulse having the voltage falling rate $V/t_1$ as shown in FIG. 11 is used, and the plasma display panel similar to that shown in FIGS. 1 and 2 is driven with the timings as shown in FIG. 3. Since the structure of the plasma display panel and the driving timing for the plasma display panel are the same as those mentioned hereinbefore, explanation will be omitted for simplification of description. In a first embodiment of the plasma display panel driving method in accordance with the first aspect of the present invention is characterized in that the sustain discharge pulse has the voltage falling rate $V/t_1$ of less than 100 V/μs, at least during the period from the moment a sustain discharge current starts to flow to the moment the sustain discharge current reaches its peak value.

Figure 12:
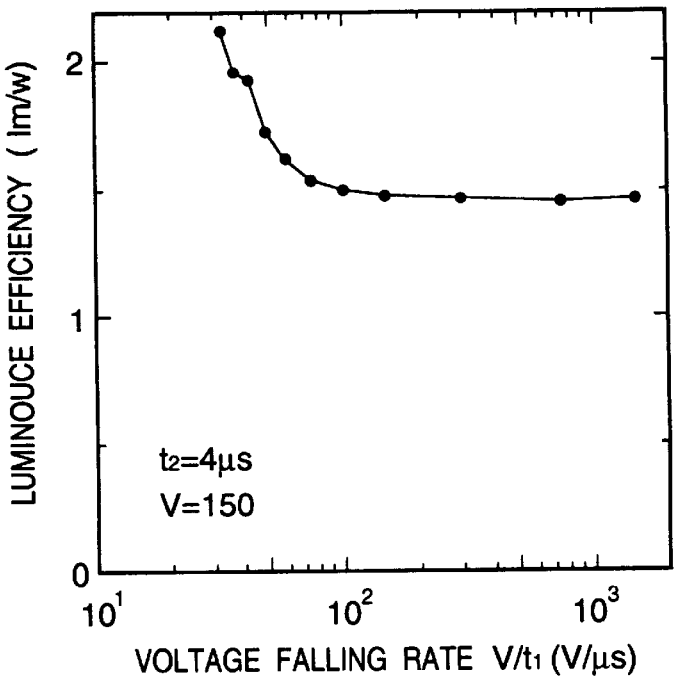
FIG. 12 is a graph illustrating the relation between the voltage falling rate and the luminance efficiency in the plasma display panel.

FIG. 12 is a graph illustrating the relation between the voltage falling rate and the luminance efficiency in the plasma display panel when the peak value "V" of the pulse is 150 V and the peak width "$t_2$" of the pulse is 4 μs. As seen from FIG. 12, if the voltage falling rate $V/t_1$ becomes low, the luminance efficiency increases. In particular, if the voltage falling rate $V/t_1$ becomes lower than 100 V/μs, the luminance efficiency increases remarkably.

For example, in the case that the driving waveforms shown in FIG. 3 are applied to the plasma display panel, assuming that the relation between the voltage falling rate and the luminance efficiency is as shown in FIG. 12 and that the peak voltage of the sustain discharge pulse is 150 V, when the sustain discharge pulse is formed of a conventional rectangular pulse having the voltage falling rate of not less than 1000 V/μs, the luminance efficiency is 1.46 lm/w, but when the sustain discharge pulse is formed of a pulse having the voltage falling rate of 33 V/μs, the luminance efficiency increases to 2.12 lm/w. This elevation of 45% of the luminance efficiency reduces the power consumption of the plasma display panel, and can relax a heat dissipation countermeasure.

Incidentally, the luminance efficiency characteristics shown in FIG. 12 is merely one example, but in the result of various measurements using different discharge gases and different PDP structures, it was confirmed that the luminance efficiency is remarkably improved when the voltage falling rate of the sustain discharge pulse becomes lower than about 100 V/μs.

Figure 11A:
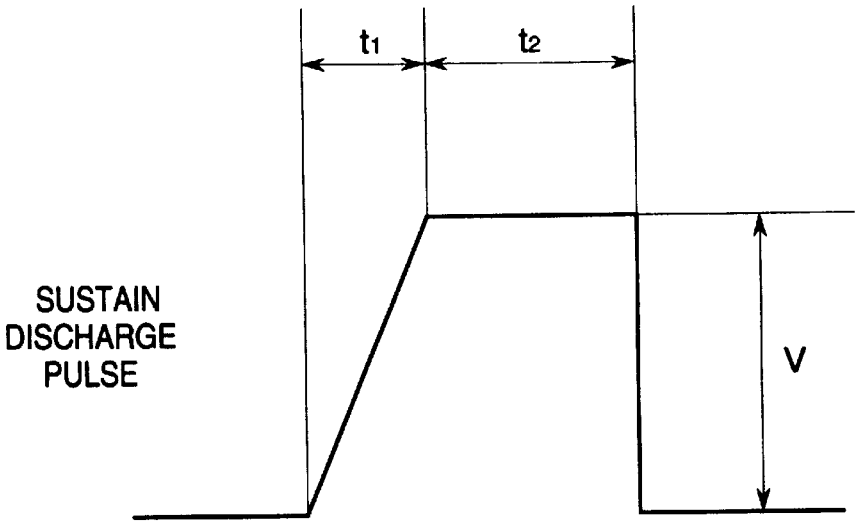
FIG. 11A illustrates the pulse shape of the positive sustain discharge pulse applied to the AC drive type plasma display panel, in the plasma display panel driving method in accordance with the second aspect of the present invention.

In the above explanation, the case using the negative sustain discharge pulse has been described. In the case using a positive sustain discharge pulse as shown in FIG. 11A, however, since the relation between the voltage raising rate of the positive sustain discharge pulse and the luminance efficiency similar to the luminance efficiency characteristics shown in FIG. 12 is obtained, a similar effect can be obtained by using the positive sustain discharge pulse having the voltage rising rate of less than 100 V/μs.

In a second embodiment of the plasma display panel driving method in accordance with the second aspect of the present invention, the sustain discharge pulse applied to the AC drive type plasma display panel can have the pulse shape as shown in FIG. 7.

In the second embodiment of the plasma display panel driving method in accordance with the second aspect of the present invention, the sustain discharge pulse falls to a predetermined voltage V1 at a very large voltage falling rate similar to that of the conventional rectangular pulse, and from the predetermined voltage V1 to the peak voltage V at a voltage falling rate $(V-V1)/t_1$ which is smaller than 100 V/μs, as seen from the luminance efficiency characteristics shown in FIG. 12.

When the sustain discharge pulse having the two different voltage falling rates changing at the voltage value V1 is used, if the voltage value V1 is set to be small, the pulse shape approaches the pulse shape of the sustain discharge pulse in the first embodiment of the second aspect of the present invention, and therefore, an effect similar to that of the first embodiment can be obtained. On the other hand, if the voltage value V1 is set to be large, the sustain discharge can be generated with a shorter time. For example, it is set that the voltage value V1 is −50 V and the peak voltage value V is −150 V, the time reaching the peak voltage value V becomes about 2 microsecond, which is shorter than 3 microseconds in the first embodiment.

In a third embodiment of the plasma display panel driving method in accordance with the second aspect of the present invention, the sustain discharge pulse applied to the AC drive type plasma display panel can have the pulse shape as shown in FIG. 8.

In the third embodiment of the plasma display panel driving method in accordance with the second aspect of the present invention, the sustain discharge pulse is set to fall to the peak voltage value "V" to depict a sine-wave, and to have such a feature that in the time $t_1$ from the moment the voltage starts to fall to the moment the voltage reaches the peak voltage "V", a momentary voltage falling rate is smaller than 100 Vμ/s. In this case, the voltage falling rate can be freely set by adjusting the period and the phase of the sustain discharge pulse.

In a fourth embodiment of the plasma display panel driving method in accordance with the second aspect of the present invention, the sustain discharge pulse applied to the AC drive type plasma display panel can have the pulse shape as shown in FIG. 9.

In the fourth embodiment of the plasma display panel driving method in accordance with the second aspect of the present invention, the sustain discharge pulse is set to fall to the peak voltage value "V" to depict an exponential function, and to have such a feature that in the time $t_1$ from the moment the voltage starts to fall to the moment the voltage reaches the peak voltage "V", a momentary voltage falling rate is smaller than 100 V/μs. In this case, the voltage falling rate can be freely set by adjusting for example an attenuation time.

The above mentioned first to fourth embodiments of the second aspect of the present invention are configured to elevate the luminance efficiency of the emitted light caused by the sustain discharge, by making the voltage falling rate of the sustain discharge pulse less than 100 V/μs. In order to obtain this advantage, it is sufficient if the voltage falling rate is smaller than 100 V/μs.

Here, the circuit shown in FIG. 10 can be used as a circuit for applying to the scan electrode the sustain discharge pulse having the voltage falling rate of less than 100 V/μs. In this case, a rectangular pulse outputted from the sustain discharge pulse output driver 1 is deformed to a pulse having a leading edge falling in an exponential function form, by the CR integrating circuit 2 connected between the output driver 10 and the scan electrode 12. This exponential function form is determined by the product of the resistance "R" of the resistor 5 and the capacitance "C" of the capacitor 6. For example, when the sustain discharge pulse output driver 1 outputs a rectangular pulse of −150 V, if C=1 nF and R=1 KΩ, the attenuation time becomes 1 microsecond, and the momentary voltage falling rate when −50 V is applied to the scan electrode becomes 100 V/μs. Therefore, if the moment the sustain discharge current starts to flow is later than the moment −50 V is applied to the electrode, the momentary voltage falling rate is smaller than 100 V/μs, with the result that the above mentioned advantage can be obtained. Therefore, if the circuit shown in FIG. 10 is used, it is possible to easily execute the method of the fourth embodiment of the second aspect of the present invention.

Even in the second aspect of the present invention, the resistor 5 can be omitted from the circuit shown in FIG. 10. In this case, the CR integrating circuit is constituted of a wiring resistance (in the output line extending from the output of the output driver 1 to the scan electrode 12) and the capacitor 6.

Alternatively, the capacitor 6 can be omitted from the circuit shown in FIG. 10. In this case, the CR integrating circuit is constituted of the resistor 5 and a floating capacitance (in the output line extending from the output of the output driver 1 to the scan electrode 12) and a load capacitance of the scan electrode 12.

The sustain discharge pulse used in the present invention is in no way limited to the pulse shapes shown in FIGS. 11 and 7 to 9, and can take any pulse shape if the voltage falling rate is smaller than 100 V/μs.

In the above explanation of the various modifications, the sustain discharge pulse is a negative going pulse. If the sustain discharge pulse is a positive going pulse, a similar advantage can be obtained by setting the positive sustain discharge pulse to have the voltage rising rate of less than 100 V/μs.

In the second aspect of the present invention, it is possible to elevate the luminance efficiency by each one sustain discharge pulse having the leading-edge voltage changing rate of less than 100 V/μs. Therefore, if the second aspect of the present invention is applied to a portion of a series of sustain discharge pulses in the driving sequence, the above mentioned advantage can be obtained in the extent that the present invention is applied. For example, even if the second aspect of the present invention is applied to only the sustain discharge pulses 25 supplied to the common electrodes, or alternatively, even if the second aspect of the present invention is applied to only the sustain discharge pulses 26 supplied to the scan electrodes, a similar advantage can be obtained.

Furthermore, the present invention can be applied to not only the AC drive type plasma display panel as mentioned above, but also the other type plasma display panels.

The invention has thus been shown and described with reference to the specific embodiments. However, it should be noted that the present invention is in no way limited to the details of the illustrated structures but changes and modifications may be made within the scope of the appended claims.

I claim:

1. In a method for driving a plasma display panel having a pair of substrates separated from each other to define a space therebetween and discharge gas sealed in the space, each of the substrates having a plurality of electrodes formed on an inside surface thereof, the plasma display panel having a high luminance condition and a low luminance condition which are separated by a leading-edge voltage changing rate of a voltage for generating a discharge between the electrodes, the method including the step of supplying a pre-discharge pulse to a predetermined electrode of said electrodes to generate a pre-discharge before a discharge is caused for a display, the improvement being that, in said pre-discharge, at least during the period from the moment a discharge current starts to flow to the moment the discharge current reaches its peak value, said leading-edge voltage changing rate of said pre-discharge pulse is at a leading-edge voltage changing rate generating said low luminance condition.

2. A method claimed in claim 1 wherein during said period from the moment the discharge current starts to flow to the moment the discharge current reaches its peak value, said leading-edge voltage changing rate of said pre-discharge pulse is less than 100 V/μs.

3. A method claimed in claim 1 wherein said pre-discharge is generated by at least one negative pulse having a predetermined peak voltage value, and the voltage falling rate of said negative pulse is less than 100 V/μs.

4. A method claimed in claim 1 wherein said pre-discharge is generated by a plurality of negative pulses, and at least one of said plurality of negative pulses has the voltage falling rate of less than 100 V/μs.

5. A method claimed in claim 1 wherein said pre-discharge is generated by at least one positive pulse having a predetermined peak voltage value, and the voltage falling rate of said negative pulse is less than 100 V/μs.

6. A method claimed in claim 1 wherein said pre-discharge is generated by a plurality of positive pulses, and at least one of said plurality of positive pulses has the voltage falling rate of less than 100 V/μs.

7. A device for driving a plasma display panel having a pair of substrates separated from each other to define a space therebetween and discharge gas sealed in the space, each of the substrates having a plurality of electrodes formed on an inside surface thereof, the plasma display panel having a high luminance condition and a low luminance condition which are separated by a leading-edge voltage changing rate of a voltage for generating a discharge between the electrodes, the device including an output driver for outputting a pre-discharge pulse to a predetermined electrode of said electrodes to generate a pre-discharge before a discharge is caused for a display, and a means connected to an output of said output driver for slowing down the leading-edge voltage changing rate of said pre-discharge pulse outputted by said output driver.

8. A device claimed in claim 7 wherein said means is constituted of a CR integrating circuit composed of a resistor connected between said output of said output driver and said predetermined electrode of said electrodes and a capacitor connected to the predetermined electrode side of said resistor.

9. A device claimed in claim 7 wherein said means is constituted of a CR integrating circuit composed of a wiring resistance in an output line extending from said output of said output driver to said predetermined electrode of said electrodes, and a capacitor connected between said output line and the ground.

10. A device claimed in claim 7 wherein said means is constituted of a CR integrating circuit composed of a resistor connected between said output of said output driver and said predetermined electrode of said electrodes, and a floating capacitance in an output line extending from said output of said output driver to said predetermined electrode of said electrodes and a load capacitance of said predetermined electrode.

11. In a method for driving a plasma display panel having a pair of substrates separated from each other to define a space therebetween and discharge gas sealed in the space, one of the substrates having a plurality of scan electrodes formed in parallel on an inside surface thereof, the other of the substrates having a plurality of data electrodes formed in parallel on an inside surface thereof, orthogonally to said scan electrodes so that one pixel is defined at each of intersections between said scan electrodes and said data electrodes, wherein a display data of each pixel is on-off controlled by a scan pulse applied to said scan electrodes and a data pulse applied to said data electrodes, and thereafter, a series of sustain discharge pulses are applied to at least said scan electrodes to generate a sustain discharge in only the pixels in which the display data have been put in an on condition, the improvement being that at least one of said sustain discharge pulses has a leading-edge voltage changing rate of less than 100 V/$\mu$s.

12. A method claimed in claim 11 wherein during the period from the moment the sustain discharge current starts to flow to the moment the sustain discharge current reaches its peak value, said leading-edge voltage changing rate of said at least one of said sustain discharge pulses is less than 100 V/$\mu$s.

13. A method claimed in claim 11 wherein the plasma display panel has a high luminance condition and a low luminance condition which are separated by a leading-edge voltage changing rate of a voltage for generating a discharge in the plasma display panel, wherein the method includes the step of supplying a pre-discharge pulse to a predetermined electrode of said electrodes to generate a pre-discharge before said scan pulse is applied to said scan electrodes and said data pulse is applied to said data electrodes, and wherein in said pre-discharge, at least during the period from the moment a discharge current starts to flow to the moment the discharge current reaches its peak value, said leading-edge voltage changing rate of said pre-discharge pulse is at a leading-edge voltage changing rate generating said low luminance condition.

14. A method claimed in claim 13 wherein during said period from the moment the discharge current starts to flow to the moment the discharge current reaches its peak value, said leading-edge voltage changing rate of said pre-discharge pulse is less than 100 V/$\mu$s.

15. A device for driving a plasma display panel having a pair of substrates separated from each other to define a space therebetween and discharge gas sealed in the space, one of the substrates having a plurality of scan electrodes formed in parallel on an inside surface thereof, the other of the substrates having a plurality of data electrodes formed in parallel on an inside surface thereof, orthogonally to said scan electrodes so that one pixel is defined at each of intersections between said scan electrodes and said data electrodes, wherein a display data of each pixel is on-off controlled by a scan pulse applied to said scan electrodes and a data pulse applied to said data electrodes, and thereafter, a series of sustain discharge pulses are applied to at least said scan electrodes to generate a sustain discharge in only the pixels in which the display data have been put in an on condition, the device including an output driver for outputting a sustain discharge pulse, and a means connected between an output of said output driver and said scan electrodes, for slowing down the leading-edge voltage changing rate of said sustain discharge pulse outputted by said output driver and supplied to said scan electrodes.

16. A device claimed in claim 15 wherein said means is constituted of a CR integrating circuit composed of a resistor connected between said output of said output driver and said scan electrodes and a capacitor connected to the scan electrode side of said resistor.

17. A device claimed in claim 15 wherein said means is constituted of a CR integrating circuit composed of a wiring resistance in an output line extending from said output of said output driver to said scan electrodes, and a capacitor connected between said output line and the ground.

18. A device claimed in claim 15 wherein said means is constituted of a CR integrating circuit composed of a resistor connected between said output of said output driver and said scan electrodes, and a floating capacitance in an output line extending from said output of said output driver to said scan electrodes and a load capacitance of said scan electrodes.

* * * * *